US005189889A

United States Patent [19]

Daily

[11] Patent Number: 5,189,889

[45] Date of Patent: Mar. 2, 1993

[54] REFRIGERANT RECLAIMING DEVICE

[75] Inventor: Bernard E. Daily, Brockport, N.Y.

[73] Assignee: CFC Solutions Corporation, Rochester, N.Y.

[21] Appl. No.: 782,168

[22] Filed: Oct. 24, 1991

[51] Int. Cl.[5] ..... F25B 45/00

[52] U.S. Cl. ..... 62/292; 62/475; 62/77; 62/85; 62/50.1

[58] Field of Search ..... 62/85, 149, 292, 474, 62/475, 50.1

[56] References Cited

U.S. PATENT DOCUMENTS

| | | | |
|---|---|---|---|
| 2,202,010 | 5/1940 | Kondolf | 62/85 |
| 3,656,313 | 4/1972 | Low et al. | 62/475 |
| 4,359,879 | 11/1982 | Wright | 62/513 |
| 4,717,406 | 1/1988 | Giacobbe | 62/475 |
| 4,856,289 | 8/1989 | Lofland | 62/149 |
| 4,887,435 | 12/1989 | Anderson, Jr. | 62/292 |

*Primary Examiner*—John Sollecito
*Attorney, Agent, or Firm*—Howard J. Greenwald

[57] ABSTRACT

An apparatus for reclaiming contaminated refrigerant is disclosed. This apparatus contains three heat exchangers, the first of which cools the refrigerant to a temperature of less than about 32 degrees Fahrenheit, the second of which cools the refrigerant to a temperature of less than about −40 degrees Fahrenheit, and the third of which cools the refrigerant to a temperature of less than about −100 degrees Fahrenheit. The device also contains filtering means, for removing from the cooled refrigerant substantially all particles larger than about 0.1 microns. The device also contains gas removing means, for removing noncondensable gas from the filtered refrigerant.

18 Claims, 4 Drawing Sheets

REFRIGERANT RECLAIMING DEVICE

FIELD OF THE INVENTION

An apparatus for reclaiming recovered refrigerant is disclosed.

BACKGROUND OF THE INVENTION

Halogenated hydrocarbons are widely used due to their inertness, low toxicity, and cleanliness. Thus, the chlorofluorocarbons are used as working fluids in air-conditioning systems used in automobiles, aircraft, and ships, in refrigerant systems used in trucks, water coolers, and commercial chillers, in industrial air conditioners, and the like. See, for example, a report by T. D. McCarson, Jr. et al. entitled "Halocarbon Recovery, Recycling, and Reclamation: Issues, Equipment, and Services" (published by the New Mexico Engineering Research Institute of Albuquerque, N. Mex. as report ESL-TR-90-30 in May of 1990, and available from the National Technical Information Service, 5285 Port Royal Road, Springfield, Va.).

It is widely believed that the halogenated hydrocarbons deplete the ozone layer surrounding the earth and thus allow the transmission of harmful radiation to the surface of the earth. Thus, thus use of halogenated hydrocarbons has been severely restricted by many major industrial countries.

In 1987, approximately 41 countries signed the "MONTREAL PROTOCOL ON SUBSTANCES THAT DEPLETE THE OZONE LAYER;" as of now, at least 62 countries have ratified such protocol. Some of the countries which are parties to this protocol include the United States, Canada, Australia, the United Kingdom, Japan, France, and Germany.

In order to encourage the recycling of halogenated hydrocarbon refrigerant, the United States Congress has enacted an excise tax on such ozone-depleting chemicals. However, recycled ozone-depleting chemicals are exempt from this tax. An example of how onerous this tax may be is presented in the December 1989 issue of "CFC Alliance: Special Bulletin" (CFC Alliance, 2011 Eye Street, N.W., Fifth Floor, Washington, D.C. 20006). On page 4 of this bulletin, an example is given of a "floor stocks tax." In this example, reference is made to an "XYZ" Company which ". . . holds 500 pounds of halon 2402 on Jan. 1, 1994. XYZ Company purchased the chemical in 1992. The floor stocks tax will equal $7,825."

Many of the States in the United States have also encouraged the recycling of halogenated hydrocarbon refrigerant by enacting strict laws governing the use of and recovery of halogenated hydrocarbons. The aim of many of these laws was to mandate the removal of halogenated hydrocarbon from refrigerant and air-conditioning systems.

However, much of the used refrigerant recovered from refrigeration systems contains impurities such as oil, acids, sludge, non-condensable materials, moisture, and the like. This impure refrigerant is not suitable for use in other refrigeration systems.

Means are available for recycling impure, recovered refrigerant. This recycling means generally comprise refrigeration filter—driers, and they generally are effective in removing up to about 90 percent of the impurities present in the recovered refrigerant. The effectiveness of such filter-driers depends upon how many times the refrigerant is cycled through the system. However, these purification means will not produce a recycled product which is substantially as pure as virgin refrigerant.

Means are also available for reclaiming impure, recovered refrigerant. These reclaiming means generally comprise a distillation apparatus. The distillation apparatus only can be used with recovered refrigerant of a specified purity.

By way of illustration, the "DuPont Refrigerant Reclamation Program" is described in document H-24085, which was published in February, 1990 by the FREON Products Division of DuPont Company (Customer Service Center, B-15305, Wilmington, Del. 19898). On page 2 of this document, it is specified that the R-11 refrigerant used in this program must be at least 99.8 weight percent pure, contain less than 1,000 parts per million of material boiling higher than the used refrigerant, contain less than 1,000 parts per million of material boiling lower than the used refrigerant, contain less than 100 parts per million of water, have a pH of at least 3.8, and contain less than 30 volume percent of oil.

By way of further illustration, the Genetron refrigerant reclamation program is described in a publication entitled "Renewing Resources To Meet The Fluorocarbon Challenge" which was published as bulletin 525–638 by the GENETRON Products Division of Allied-Signal Inc. (Post Office Box 1139R, Morristown, N.J.). In this publication it is specified that the recovered R-12 refrigerant, to be acceptable for the process, must be at least about 99.5 weight percent pure, contain less than 80 parts per million of water, have a pH of at least 3.5, and contain less than 30 volume percent of oil.

In addition to not being suitable for all recovered refrigerant, the use of the distillation apparatuses requires substantial expenditures of energy. Relatively high temperatures, high pressures, and large batches of material must be used. The use of these high temperatures and pressures increases the risk of venting refrigerant material to the atmosphere.

It is an object of this invention to provide an apparatus for reclaiming recovered refrigerant which is capable of producing refrigerant which is substantially as pure as new, virgin refrigerant.

It is another object of this invention to provide an apparatus for reclaiming recovered refrigerant which may be used with substantially any impure recovered refrigerant, regardless of the extent of the impurity or the chemical composition of the refrigerant.

It is another object of this invention to provide an apparatus for reclaiming recovered refrigerant which may be used at a temperature lower than ambient.

It is another object of this invention to provide an apparatus for reclaiming recovered refrigerant whose operation does not present a substantial risk of venting refrigerant vapor to the atmosphere.

SUMMARY OF THE INVENTION

In accordance with this invention, there is provided a device for reclaiming recovered refrigerant. This device is comprised of a container for recovered refrigerant, a refrigerant strainer, a pump, a series of heat exchangers, and a filtration device.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

The apparatus of this invention is designed to reclaim recovered refrigerant so that, after such reclamation, the recovered refrigerant is substantially as pure as new, virgin refrigerant.

Many means are known to those skilled in the art for recovering refrigerant. There are at least 25 United States companies which manufacture equipment designed to recover the chlorofluorocarbons. There are five United States companies which provide equipment which can recover the halons.

Every halogenated hydrocarbon recovery system which is currently available for the recovery of both chlorofluorocarbons and halons contains a compressor or a pump. Thus, for example, one of the most widely sold of such systems is the Robinair "Model 17500," which is described in U.S. Pat. Nos. 4,763,347, 4,805,416, 4,809,520, and 4,878,356. This system, which is manufactured by the SPX Corporation of Montpelier, Ohio, has a configuration which is typical of the refrigerant recovery systems currently on the market. Thus, this Robinair system contains a compressor, a condenser, a liquid pump filtering system, an oil separator, and many other components; see, e.g., the "Robinair Operating Manual" for "Model 17500" (publication 109943 89-59 [3/90], published by the Ronbinair Division, SPX Corporation, Robinair Way, Montpelier Ohio 43543).

By way of further illustration, another refrigerant recovery system is provided by the Van Steenburgh Engineering Laboratories, Inc. of 1900 South Quince Street, Denver, Col.

The recovered refrigerant produced by these or other means may be used in applicant's process. In general, such recovered refrigerant contains from about 0 to about 60 volume percent of oil from about 0 to about 25 weight percent of water, and a purity (excluding oil) of at least about 40 weight percent.

Figure 1:
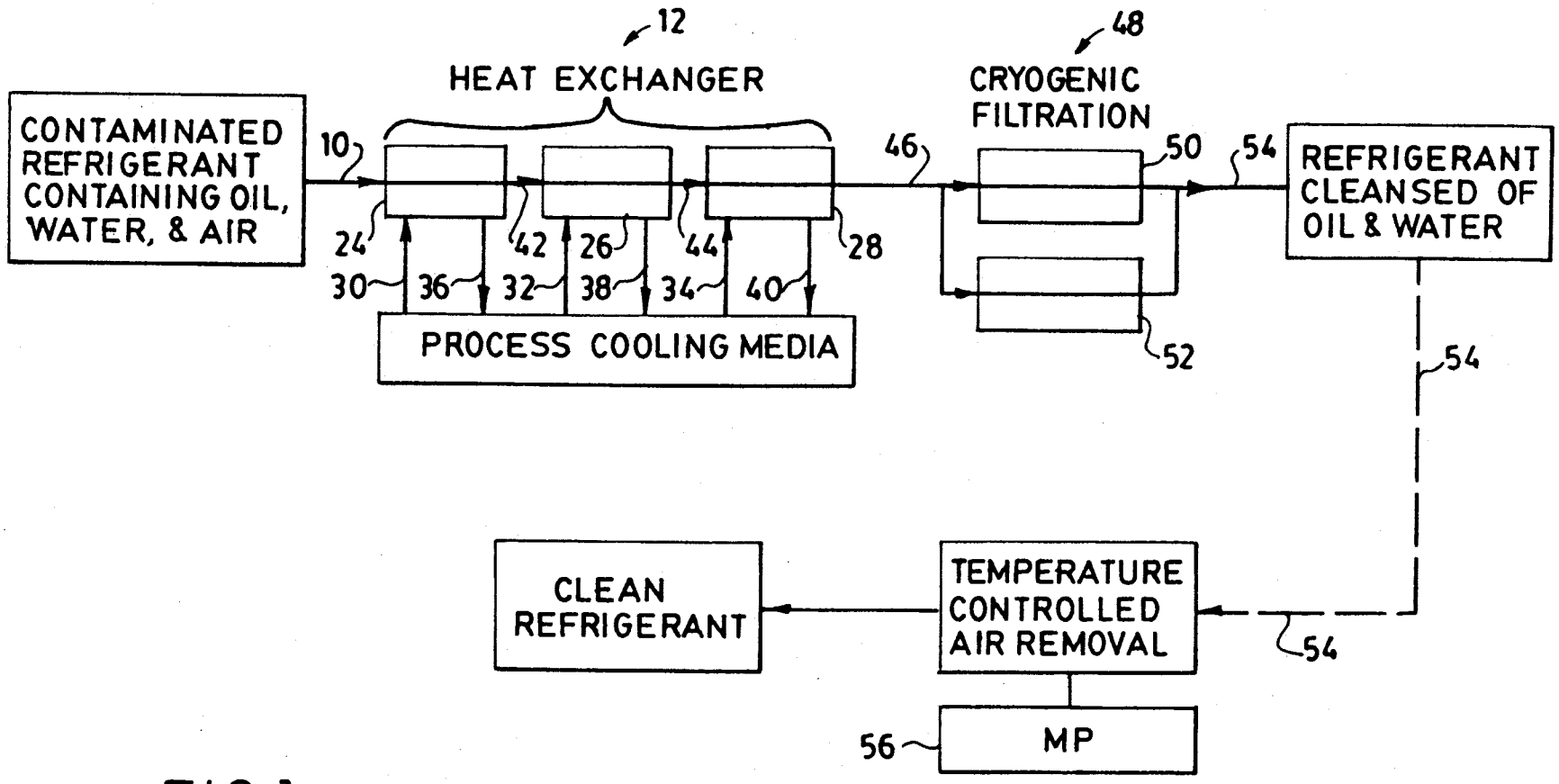
FIG. 1 is a block diagram of a preferred process of the invention.

The preferred process of applicant's invention is illustrated in FIG. 1. Referring to FIG. 1, it will be seen that contaminated refrigerant containing oil, water, and noncondensables is first passed via line 10 to heat exchanger 12.

A contaminated refrigerant which, under ambient temperature and conditions is substantially liquid but also contains a gaseous phase, may be used. These refrigerants are well known to those skilled in the art and are described in the "1989 ASHRAE Handbook Fundamentals," I-P Edition (American Society of Heating, Refrigerating and Air Conditioning Engineers, Inc., 1791 Tullie Circle, N.E., Atlanta, Ga., 1989). Thus, by way of illustration and not limitation, suitable contaminated refrigerants which may be used include contaminated chlorofluorocarbon and/or halon refrigerants currently in use. Many of these materials contain from about 1 to about 5 carbon atoms and at least about two halogen atoms selected form the group consisting of chlorine, fluorine, bromine, and iodine atoms and mixtures thereof. Thus, by way of illustration, one may recover contaminated trichlorofluoromethane, dichlorodifluoromethane, 1,,2-trichloro-1,2,2-trifluoroethane, 1,2-dichloro-1,1,2,2-tetrafluoroethane, 1-chloro-1,1,2,2,2,-pentafluoroethane, bromochlorodifluoromethane, bromotrifluoromethane, 1,2-dibromo-1,1,2,2-tetrafluoroethane, an azeotropic mixture of 74 weight percent of dichlorodifluoromethane and difluoroethane, an azeotropic mixture of 49 weight percent of chlorodifluoromethane and 1-chloro-1,1,2,2,2,-pentafluoroethane, bromochloromethane, chlorodifluoroethane, 2,2-dichloro-1,1,1-trifluoroethane, 2-chloro-1,1,1,2-tetrafluoroethane, pentafluoroethane, 1,1,1,2-tetrafluoroethane, 1,1-dichloro-1-fluoroethane, 1-chloro-1,1-difluoroethane, 1,1,1-tetrafluoroethane, 1,1-difluoroethane, and the like.

Figure 2:
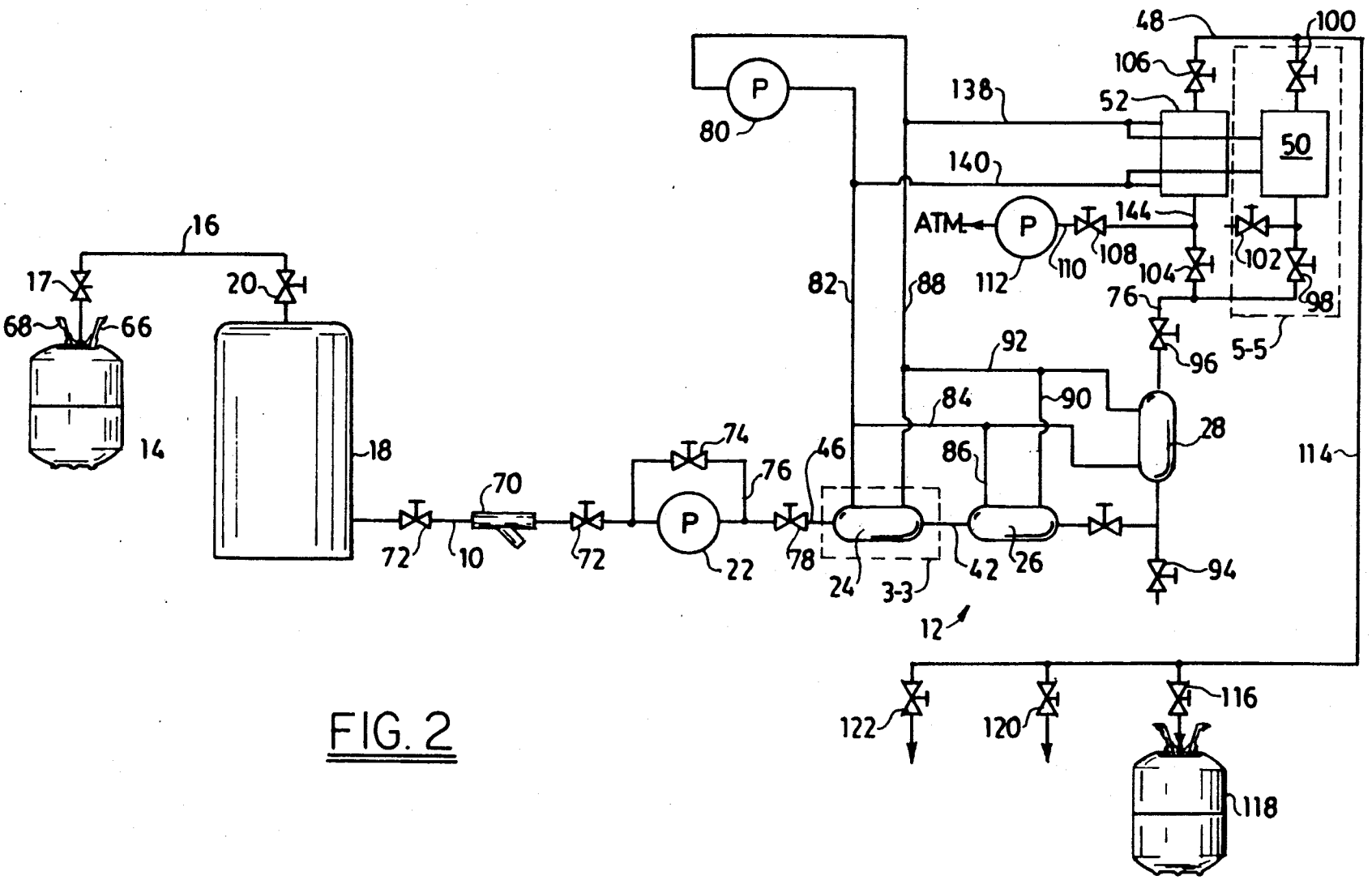
FIG. 2 is a schematic diagram of one preferred embodiment of the apparatus of the invention.

In one preferred embodiment, illustrated in FIG. 2, the impure refrigerant will be enclosed in a container 14. In this embodiment, it is preferred that container 14 is preferably a refrigerant container. These containers are well known to those skilled in the art and are described, e.g., on page 293 of said "Modern Refrigeration and Air Conditioning" text. It is preferred that container 14 be substantially cylindrical.

In one embodiment, container 14 is a storage cylinder. In another embodiment, container 14 is a returnable service cylinder.

The container 14 will preferably be a cylinder which consists essentially of steel or aluminum. In one embodiment, container 32 will have a fusible plug safety device threaded into its concave bottom as a protection against overheating or excessive pressures.

It is preferred that container 14 contain at least one valve, valve 17, attached to container 14 at its top to provide a connection for charging or discharging service cylinders. In an even more preferred embodiment, container 14 contains two valves at its top, one to release gas, and the other to attach to a dip tube to release liquid.

Referring again to FIG. 2, in the embodiment illustrated therein, the impure refrigerant from refrigerant container 14 is preferably passed via line 16 to storage container 18. Valves 17 and 20 may be used to control the flow of the impure refrigerant into the storage container 18.

As will be apparent to those in the art, storage container 18 may be used to store relatively large quantities of refrigerant prior to the time the process of applicant's invention is conducted. Furthermore, storage container 18 provides a volume of refrigerant which is sufficient to maintain suction on pump 22, and it supplies a pressure head to pump 22 sufficient to avoid cavitation.

Referring again to FIG. 1, contaminated refrigerant from container 14 and/or container 18 is passed to heat exchanger 12. In the preferred embodiment illustrated in FIG. 1, heat exchanger 12 is preferably comprised of at least about three separate heat exchanging units, heat exchangers 24, 26, and 28.

As is known to those skilled in the art, a heat exchanger is a device used to transfer heat from a fluid and/or gas flowing on one side of a barrier to another fluid (or fluids) flowing on the other side of the barrier. See, for example, pages 415-417 of Volume 6 of the McGraw-Hill Encyclopedia of Science and Technology(McGraw-Hill Book Company, New York, 1977). Also see page 432 of Andrew D. Althouse et al.'s "Modern Refrigeration and Air Conditioning" (The Goodheart-Willcox Company, INc., South Holland, Ill.). FIGS. 12-99 and 12-100 on such page illustrate a typical tube-in-tube heat exchanger which may advantageously be used in applicant's system.

Heat exchanger's 24, 26, and 28 may be cooled by either open cycle or closed cycle refrigeration. In the embodiment illustrated in FIG. 1, open cycle cooling in which the heat exchanger is contacted with process cooling media is illustrated.

The process cooling media used in the invention may be any expandable refrigerant. As used in this specification, the term expendable refrigerant refers to a refrigerant which forms a gas upon the application of energy and when, in gaseous form, can be vented to the atmosphere. The use of this type refrigerant is often referred to as "open cycle refrigeration."

A refrigerant with a boiling point, at a pressure of 14.696 pounds per square inch absolute, of less than −100 degrees Fahrenheit, may be used. These refrigerants are well known to those skilled in the art and are described in the "1989 ASHRAE Handbook Fundamentals," I-P Edition (American Society of Heating, Refrigerating and Air Conditioning Engineers, Inc., 1791 Tullie Circle, N.E., Atlanta, Ga., 1989).

Thus, by way of illustration, one may use refrigerants such as helium, hydrogen, neon, nitrogen, air, argon, oxygen, methane, tetrafluoromethane, ethylene, ethane, nitrous oxide, trifluoromethane, chlorotrifluoromethane, carbon dioxide, and the like.

It is preferred that the refrigerant used be selected from the group consisting of carbon dioxide, and nitrogen.

Referring again to FIG. 1, the process cooling media may be provided to heat exchangers 24, 26, and 28 via lines 30, 32, and 34, and the heated cooling media may be returned via lines 36, 38, and 40.

Referring again to FIG. 1, heat exchanger 24 provides means for cooling the contaminated refrigerant to a temperature of less than about 32 degrees Fahrenheit, thereby causing any water in the refrigerant to freeze. It is preferred that, in heat exchanger 24, the temperature of the contaminated refrigerant fed to such heat exchanger via line 10 be reduced to a temperature of less than about 20 degrees Fahrenheit and, more preferably, less than about 10 degrees Fahrenheit.

The contaminated refrigerant which has been cooled in heat exchanger 24 is then passed via line 42 to heat exchanger 26. This heat exchanger 26 provides means for reducing the temperature of the contaminated refrigerant by at least about 50 degrees Fahrenheit (and preferably at least about 60 degrees Fahrenheit) until the temperature of the contaminated refrigerant is at least as low as −40 degrees Fahrenheit and, preferably, at least as low as −50 degrees Fahrenheit. It is preferred that the temperature of the refrigerant in this second heat exchanger 26 is from about −40 to about −50 degrees Fahrenheit.

The cooled refrigerant from the second stage is then passed via line 44 to heat exchanger 28, in which it is cooled to a temperature of at least as low as about—minus 100 degrees Fahrenheit. In one preferred embodiment, the temperature of the fluid after it has contacted heat exchanger 28 is between from about −100 to about −120 degrees Fahrenheit.

The cooled material in heat exchanger 28 comprises liquid refrigerant, solid water, and fluid oil at high viscosity. This material is then passed via line 46 to cryogenic filtration unit 48 which is adapted to strain the solid water and the semisolid oil from the refrigerant stream.

In one preferred embodiment, cryogenic filtration unit 48 is comprised of coalescing filters 50 and 52. In this embodiment, if one of filters 50 and 52 becomes plugged with impurities, it may be shut down and cleaned while the impure material is passed through the other of said filters, thereby avoiding the need to shut down the process.

The contaminants in the contaminated refrigerant are caused to coalesce in heat exchanger 12 so that the average particle size of the contaminant particles is greater than about 0.1 microns. The coalesced contaminant particles may then be removed in coalescing filters 50 and/or 52.

Coalescing filters are well known to those skilled in the art. Thus, by way of illustration and not limitation, one may use as filter 50 and/or 52 a coalescing filter, part numbers G20-420-6 (filter housing) and DO (the filter cartridge), manufactured by Monnier Company and available from the R. L. Stone Company of Rochester, N.Y. This filter is capable of removing at least 93 percent of the particles less than 0.1 micron in diameter, and substantially all of the particles greater than 0.1 micron in size. Thus, this filter will remove substantially all of the ice, oil, and sludge particles in the refrigerant.

Figure 7:
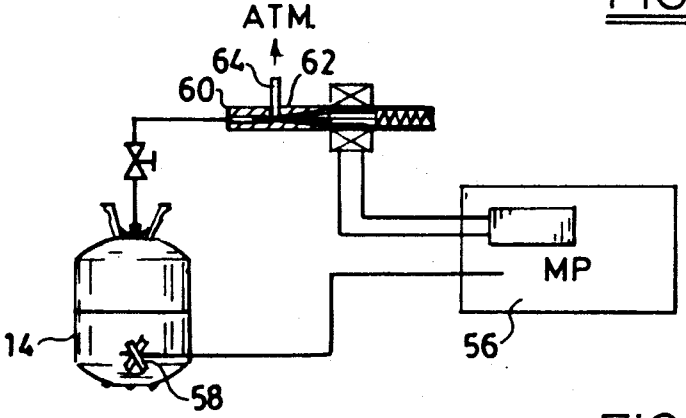
FIG. 7 is a schematic diagram of purge/discriminator unit which may be used in one embodiment of the apparatus of the invention.

The filtrate from filter 50 and/or filter 52 is then passed via line 54 to a storage container, such as container 14; see, for example, FIG. 7. At this point, although the refrigerant has been cleansed of solid and semisolid material, it still may contain noncondensable material.

Referring again to FIG. 7, the container 14 comprising the partially cleansed refrigerant is preferably allowed to stand under ambient conditions for at least about 24 hour. Thereafter, microprocessor 56 is operatively connected to a a pressure and temperature sensor 58 and a pressure sensor 60. The microprocessor 56 contains a program which describing the pressure--temperature relationship of the refrigerant.

Whenever microprocessor 56 senses a pressure which is at least about 3 p.s.i. greater than the ideal saturated pressure of the refrigerant at that temperature, it then concludes that noncondensable impurities are present in the material. If and when these impurities are present, they tend to rise to the of container 14. When the microprocessor 56 senses the presence of such impurities, it activates a solenoid 62 and opens vent 64 to allow noncondensable gas to vent to the atmosphere. Vent 64 is opened for a relatively short period of time, on the order of from about 0.005 to about 0.02, to allow a limited amount of gas to escape. The process may repeated at varying intervals until and unless the microprocessor senses that the pressure of the mixture is less than about 3 p.s.i. greater than the desired pressure.

By way of illustration, microprocessor 56 may comprise a Texas Instrument TMS 370 microprocessor.

FIG. 2 is a schematic diagram of one preferred embodiment of applicant's invention.

Referring to FIG. 2, it will be seen that container 14 preferably is comprised of handles 66 and 68. The impure, recovered refrigerant in container 14, when valves 17 and 20 are both in the open position, may be allowed top pass to container 18. In one embodiment, not shown, gravity may be used to cause the flow of material from containers 14 to 18; in this embodiment, container 14 preferably is disposed above container 18. In another embodiment, a pressure differential may be used to cause the material to flow from container 14 to container 18; this pressure differential may be created by pump 22.

In one embodiment, a specified volume of impure, recovered refrigerant is collected in container 18 prior to the time it is allowed to be purified in the process. In this embodiment, it is preferred to collect at least about 50 pounds of refrigerant in container 18 prior to passing any of the refrigerant via line 10 to strainer 70.

Valve 17 and/or valve 20 may be conventional disconnect valves. Valve 72 is preferably an isolation valve. These valves are well known to those skilled in the art and are described, e.g., in Nohle's Refrigeration Supplies Catalog (published by the Nohle Company, 1144 East Main, Rochester, N.Y. 14609).

The impure, recovered refrigerant fed through line 10 is passed through strainer 70. This strainer, which is comprised of screening with an opening of about 0.125 inches, will remove all solid particles greater than about 0.125 inches, thereby protecting pump 22.

The filtrate from strainer 70 may be passed through isolation valve 72 and thence to pump 22.

Pump 22 is preferably a positive displacement pump. It is operatively connected to pressure relief valve 74, which may be either internal or external to pump 22. If, for any reason, the line pressure downstream of pump 22 exceeds a certain critical value, pressure relief valve 74 will open, and material will flow through line 76 back to the upstream side of pump 22, thereby avoiding damage to the system. As will be apparent to those skilled in the art, the line pressure downstream of pump 22 may substantially increase if filters 50 and/or 52 become clogged, or if one or more of the valves downstream from pump 22 become closed.

Pump 22 is designed to overcome the equivalent head pressure of all of the components of the piping system and to pump a specified volume of refrigerant. It is preferred that pump 22 pump refrigerant at volume of from about 1 to about 5 pounds per minute and, more preferably, from about 1 to about 3 pounds per minute.

Referring again to FIG. 2, isolation valve 78 is provided in order to be able to isolate pump 22 and/or heat exchangers 24 and 26.

The material passing through valve 78 is fed via line 46 to heat exchanger 24, in which the temperature of the material is preferably reduced to at least about 10 degrees Fahrenheit. In the preferred embodiment illustrated in FIG. 2, heat exchangers 24, 26, and 28 each are manufactured by Doucette Industries of Waco Tex. 76710 as model HXR-25.

Referring again to FIG. 2, a source 80 of liquid nitrogen under pressure is passed via line 82 to heat exchanger 24, via lines 82, 84, and 86 to heat exchanger 26, and via lines 82 and 84 to heat exchanger 28. The liquid nitrogen is returned to source 80 via lines 88, 90, 92, and 88, and 92 from heat exchangers 24, 26, and 28, respectively.

The material from heat exchanger 24 is then passed to heat exchanger 26 via line 42. In heat exchanger 26, the temperature of the refrigerant is reduced to a temperature of from about −40 to about −60 degrees Fahrenheit. The material thus cooled is then passed to heat exchanger 28, in which the temperature of the material is then preferably reduced to a temperature of from about −100 to about −120 degrees Fahrenheit.

Purge valve 94 may be utilized to remove any impurities which may have collected in heat exchangers 24 and/or 26 and/or 28. Thus, valve 94 may be opened to remove ice, sludge, viscous oil, and other impurities from the heat exchanger(s). When it is desired to remove such impurities from the heat exchanges, the heat exchangers may be isolated from the remainder of the system by closing valves 78 and 96 and thereafter opening valve 94.

The cooled material from heat exchanger 28 may be passed via line 46 to cryogenic filtration apparatus 48 comprised of filters 50 and 52. It will be seen that, in the preferred embodiment illustrated in FIG. 2, each of filters 50 and 52 is supplied with isolation and purge valves. Thus, filter 50 is operatively connected to isolation valve 98, isolation valve 100, and purge valve 102. Thus, filter 52 is operatively connected to isolation valve 104, isolation valve 106, and purge valve 108.

The material which passes through purge valve 108 is then passed via line 110 a refrigerant reclaim unit 112 via said units evacuation port (not shown). Thereafter, Once the filter housing (not shown in FIG. 2) of unit 112 has been evacuated, the filter may be opened up, and the filter cartridge (not shown in FIG. 2) may be removed.

Referring again to FIG. 2, material which has passed through filter 50 and/or filter 52 may be passed via line 114 and valve 116 to distribution header 118, in which it may be deposited and thereafter used to fill evacuated bottles with purified refrigerant through fill valves 116, 120, and 122.

The material in header 118 still may contain noncondensable gas. This gas may be removed via purge unit, such as that illustrated in FIG. 7.

Figure 3:
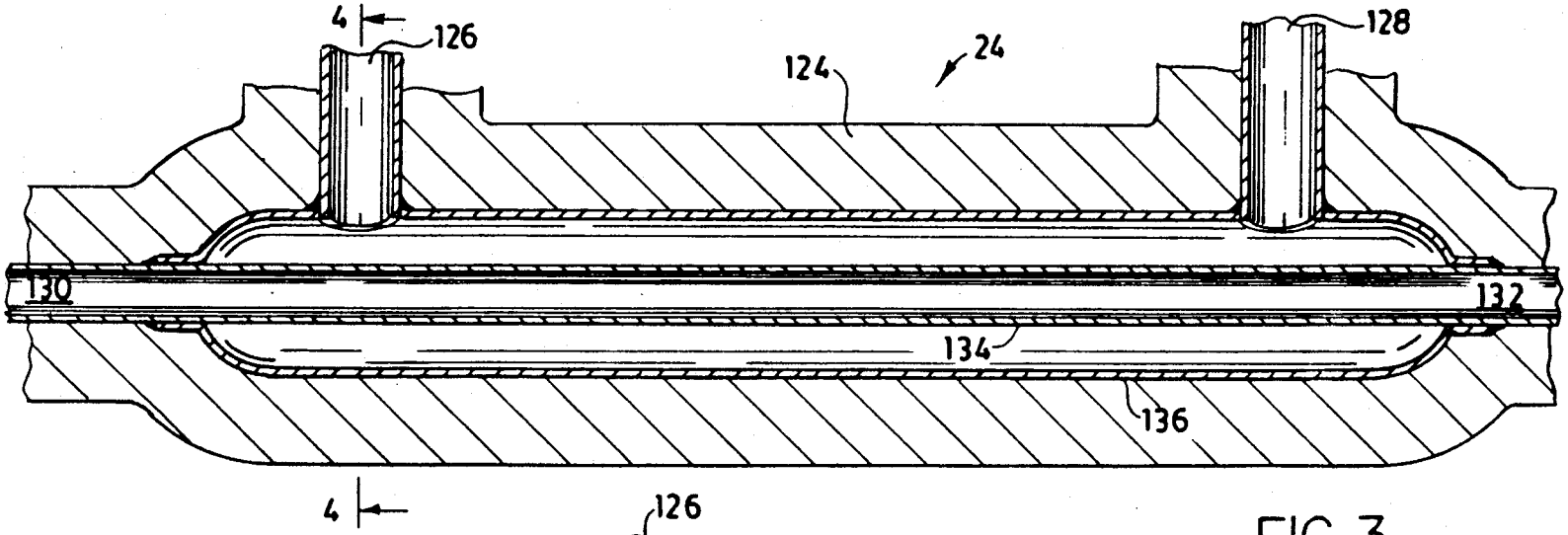
FIG. 3 is an side sectional view of the heat exchanger of the apparatus of FIG. 2.
Figure 4:
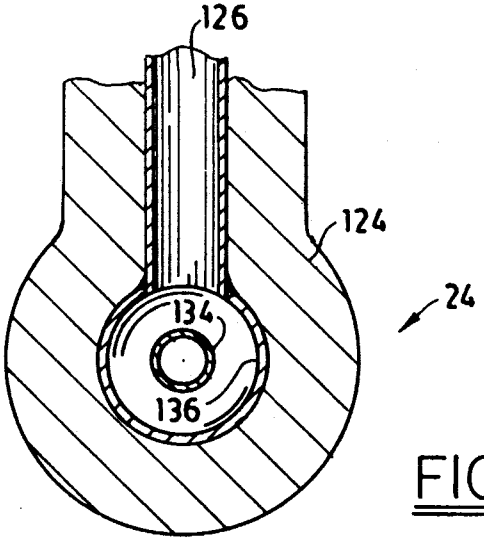
FIG. 4 is a end sectional view of the heat exchanger of the apparatus of FIG. 2.

FIG. 3 is a sectional view of heat exchanger 24. Referring to FIG. 3, it will be seen that heat exchanger 24 preferably is comprised of insulation 124, liquid nitrogen input port 126, liquid nitrogen output port 128, impure refrigerant input line 130, cooled refrigerant output line 132, interior tube section 134, and exterior tube section 136.

Figure 6:
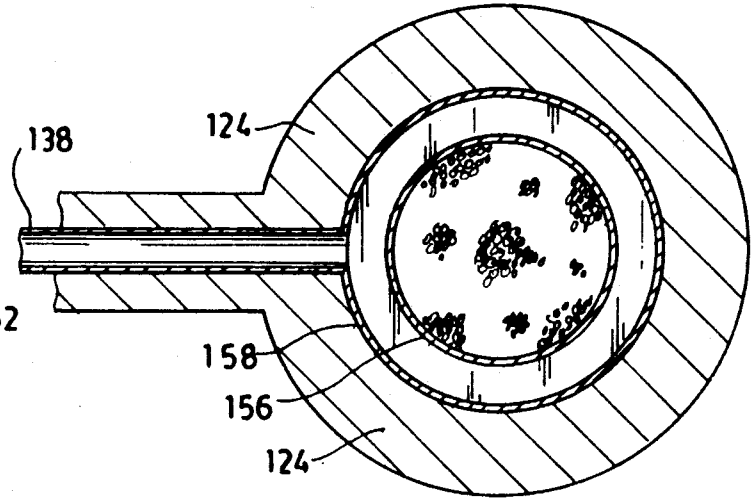
FIG. 6 is a top sectional view of the filtering means of the apparatus of FIG. 2.

Referring again to FIG. 2, it will be seen that filters 50 and 52 are operatively connected to cooling lines which, in turn, is connected to a cooling unit 142 (not shown in FIG. 2). However, one preferred embodiment of cooling unit 142 is illustrated in FIGS. 5 and 6.

Figure 5:
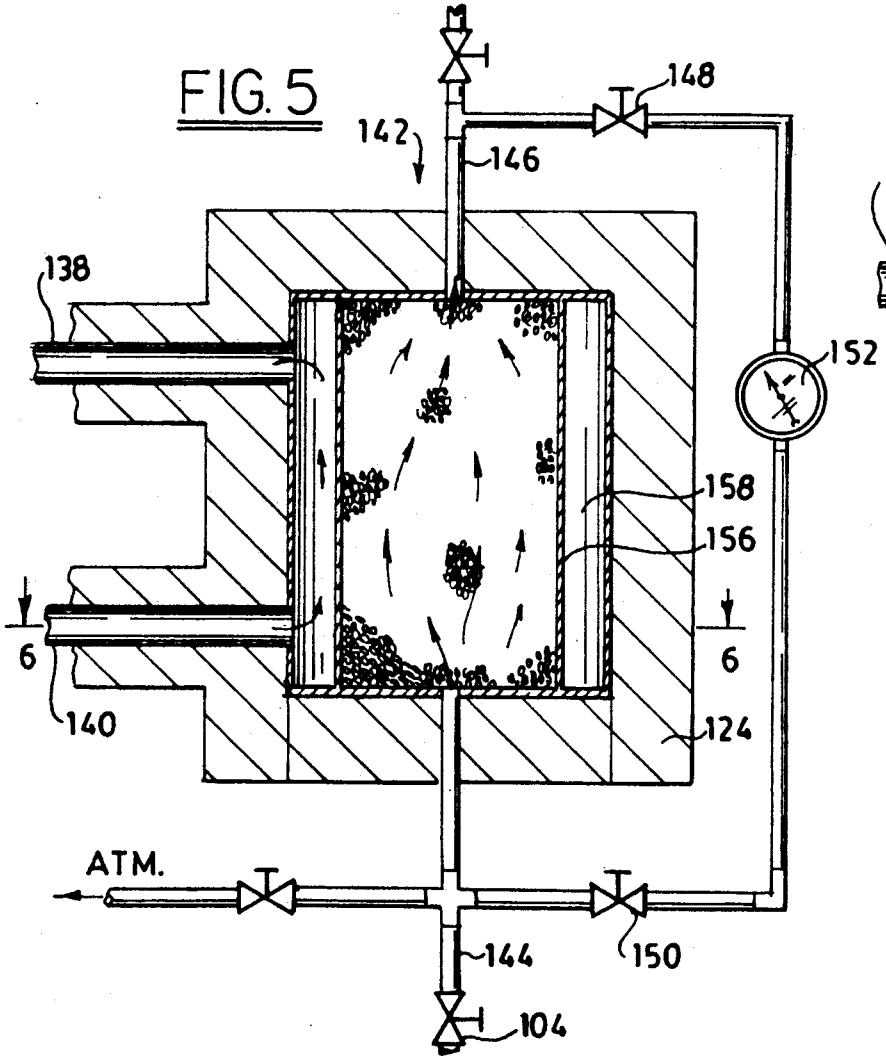
FIG. 5 is a side sectional view of the filtering means of the apparatus of FIG. 2.

Referring to FIG. 5, it will be seen that cooling unit 142 is comprised of liquid nitrogen cooling lines 138 and 140, refrigerant input line 144, refrigerant output line 146, valves 148 and 150, pressure gauge 152, insulation 124, filter cartridge 156, and exterior chamber 158.

It is to be understood that the aformentioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An apparatus for reclaiming contaminated refrigerant, comprising:

(a) first heat exchanger means for cooling said contaminated refrigerant to a temperature of less than about 32 degrees Fahrenheit;

(b) second heat exchanger means for cooling said contaminated refrigerant to a temperature of less than about −40 degrees Fahrenheit;

(c) third heat exchanger means for cooling said contaminated refrigerant to a temperature of less than about −100 degrees Fahrenheit, wherein each of said first heat exchanger means, said second heat exchanger means, and said third heat exchanger means is a tube-in-tube heat exchanger which is comprised of a liquid nitrogen input port and a liquid nitrogen output port;

(d) filtering means for removing from said contaminated refrigerant at a temperature of less than about −100 degrees Fahrenheit substantially all of the particles in said refrigerant with a maximum dimension in excess of about 0.1 microns, wherein said filtering means is adapted to produce a filtered refrigerant; and (e) gas removing means for removing noncondensable gas from said filtered refrigerant, wherein said gas removing means is adapted to produce a filtered and degassed refrigerant.

2. The apparatus as recited in claim 1, wherein said filtering means is comprised of a first filter and a second filter.

3. The apparatus as recited in claim 1, wherein said gas removing means is comprised of a pressure sensor.

4. The apparatus as recited in claim 3, wherein said gas removing means is comprised of a temperature sensor.

5. The apparatus as recited in claim 4, wherein said gas removing means is comprised of a container with a vent.

6. The apparatus as recited in claim 5, wherein said gas removing means is comprised of means for opening said vent whenever said pressure of said refrigerant exceeds a desired value.

7. The apparatus as recited in claim 1, wherein said apparatus is comprised of a first storage container and a second storage container.

8. The apparatus as recited in claim 7, wherein said apparatus is comprised of means for causing said contaminated refrigerant to flow from said first storage container to said second storage container.

9. The apparatus as recited in claim 1, wherein said apparatus is comprised strainer means for removing solid particles with a maximum dimension in excess of 0.125 inches from said contaminated refrigerant.

10. The apparatus as recited in claim 1, wherein said apparatus is comprised of a pump.

11. The apparatus as recited in claim 10, wherein said pump is a positive displacement pump.

12. The apparatus as recited in claim 10, wherein said pump is a centrifugal pump.

13. The apparatus as recited in claim 1, wherein at least one of said first heat exchanger, said second heat exchange, and said third heat exchanger is operatively connected to a purge valve.

14. The apparatus as recited in claim 1, wherein said apparatus is comprised of a refrigerant reclamation unit.

15. The apparatus as recited in claim 1, wherein each of said liquid nitrogen input port and said liquid nitrogen output port consists essentially of copper.

16. The apparatus as recited in claim 2, wherein each of said first filter and said second filter is operatively connected to a cooling means.

17. The apparatus as recited in claim 16, wherein said cooling means is comprised of two liquid nitrogen input lines, an exterior chamber, and a filter cartridge disposed within said exterior chamber.

18. The apparatus as recited in claim 17, wherein each of said filters is operatively connected to a pressure gauge.

* * * * *